US008104569B2

(12) United States Patent
Klein

(10) Patent No.: US 8,104,569 B2
(45) Date of Patent: Jan. 31, 2012

(54) SPEAKER CABINET SYSTEM

(76) Inventor: Daniel B. Klein, Wilmington, NC (US)

( * ) Notice: Subject to any disclaimer, the term of this patent is extended or adjusted under 35 U.S.C. 154(b) by 0 days.

(21) Appl. No.: 12/845,454

(22) Filed: Jul. 28, 2010

(65) Prior Publication Data

US 2011/0024226 A1 Feb. 3, 2011

Related U.S. Application Data

(60) Provisional application No. 61/229,309, filed on Jul. 29, 2009.

(51) Int. Cl.
*H04R 1/02* (2006.01)

(52) U.S. Cl. ..... 181/199; 181/155

(58) Field of Classification Search ..... 181/148, 181/151, 152, 155, 156, 189, 191, 194, 199; 381/337, 340, 341, 345, 352, 160, 335, 336, 381/346, 347, 348, 349
See application file for complete search history.

(56) References Cited

U.S. PATENT DOCUMENTS 2,337,213 A * 12/1943 Topping, Jr. ..... 181/156
2,805,729 A * 9/1957 Read ..... 181/156
2,806,546 A * 9/1957 Galyon et al. ..... 181/151
2,866,514 A * 12/1958 Weathers ..... 181/151
3,385,394 A * 5/1968 Gundlach ..... 181/143
3,666,041 A * 5/1972 Engelhardt ..... 181/145
4,128,738 A * 12/1978 Gallery ..... 381/335
4,286,688 A * 9/1981 O'Malley ..... 181/156
4,750,585 A * 6/1988 Collings ..... 181/148
4,807,293 A * 2/1989 Weckler ..... 381/349
4,853,964 A * 8/1989 Weckler ..... 381/341
5,056,616 A * 10/1991 Astrom ..... 181/156
5,373,564 A * 12/1994 Spear et al. ..... 381/352
5,815,589 A * 9/1998 Wainwright et al. ..... 381/346
6,324,292 B1 * 11/2001 Mitsuhashi et al. ..... 381/349
2004/0238268 A1 * 12/2004 Danley et al. ..... 181/199
2005/0087392 A1 * 4/2005 Flanders et al. ..... 181/156
2007/0000720 A1 * 1/2007 Noro et al. ..... 181/156
2007/0158134 A1 * 7/2007 Fryette ..... 181/199
2008/0130932 A1 * 6/2008 Schultz ..... 381/337
2008/0302595 A1 * 12/2008 Moore ..... 181/199

* cited by examiner

*Primary Examiner* — Jeremy Luks
(74) *Attorney, Agent, or Firm* — Douglas A. Scholer

(57) ABSTRACT

A speaker cabinet includes a first surface oriented generally along a first plane and a second surface oriented generally along a second plane. The second plane is generally orthogonal to the first plane. A third surface may be positioned between the first and second surfaces and may be oriented generally along a third plane that intersects the first plane and the second plane. The third surface may be configured to redirect an audio signal.

8 Claims, 4 Drawing Sheets

SPEAKER CABINET SYSTEM

I. CROSS-REFERENCE TO RELATED APPLICATION

This application claims priority from provisional application Ser. No. 61/229309, filed on 29 Jul. 2009, entitled "Cabinet and Related Method," the teachings of which are incorporated by reference herein.

II. FIELD OF THE INVENTION

The present invention relates generally to audio equipment, and more specifically, to cabinetry configured to house speaker circuitry.

III. BACKGROUND

Effective speaker cabinet design accounts for interaction between the characteristics of one or more of a loudspeaker, an amplifier, and cabinet alignment values. In a combination ("combo") design, an amplifier is housed with one more speakers in a wooden cabinet. A standalone amplifier arrangement (often called a "head" or "amp head") does not include a speaker and passes electrical current through a speaker cable to the speaker cabinet or "cab."

A loudspeaker, or speaker, may include an electroacoustic transducer that converts an electrical signal into sound. The speaker moves in accordance with the variations of an electrical signal and causes sound waves to propagate through air. An amplifier may be designed to make the signal of an electric or acoustic guitar louder and may modify tone by emphasizing or de-emphasizing certain frequencies and by adding electronic effects.

Sound waves from the speaker can become trapped between the back of the amplifier and/or speaker and a back panel of the cabinet. The right angles of cabinet corners, in particular, may absorb or slow down sound waves, causing an increase in pressure. The tapped sound and redirected waves represent lost audio potential. Moreover, the escaping, unfocused sound waves may cancel, distort, or otherwise be out of synchronization with the other sound waves.

IV. SUMMARY OF THE DISCLOSURE

In a particular embodiment, an apparatus includes a speaker cabinet comprising a first surface oriented generally along a first plane and a second surface oriented generally along a second plane. The second plane is generally orthogonal to the first plane. A third surface may be positioned between the first and second surfaces and may be oriented generally along a third plane that intersects the first plane and the second plane. The third surface may be configured to redirect an audio signal.

In another embodiment a method of constructing a speaker cabinet may include orienting a first surface generally along a first plane and orienting a second surface generally along a second plane. The second plane may be generally orthogonal to the first plane. A third surface may be positioned between the first and second surfaces. The third surface may be oriented generally along a third plane that intersects the first plane and the second plane, and the third surface may be configured to redirect an audio signal.

The orientation of the surfaces may work in combination to minimize occurrences of trapped and absorbed audio signals. These features may reduce pressure in the speaker cabinet and may redirect audio waves to realize increased audio potential.

By focusing and harnessing the sound waves, synchronization, tone and overall sound quality may be improved.

These and other advantages and features that characterize the invention are set forth in the claims annexed hereto and forming a further part hereof. However, for a better understanding of the invention, and of the advantages and objectives attained through its use, reference should be made to the Drawings and to the accompanying descriptive matter in which there are described exemplary embodiments of the invention.

V. BRIEF DESCRIPTION OF THE DRAWINGS

FIG. 1 a cross-sectional, perspective view of a first embodiment of a speaker cabinet system configured to harness and focus sound waves in a manner that optimizes sound quality;

VI. DETAILED DESCRIPTION

Figure 1:
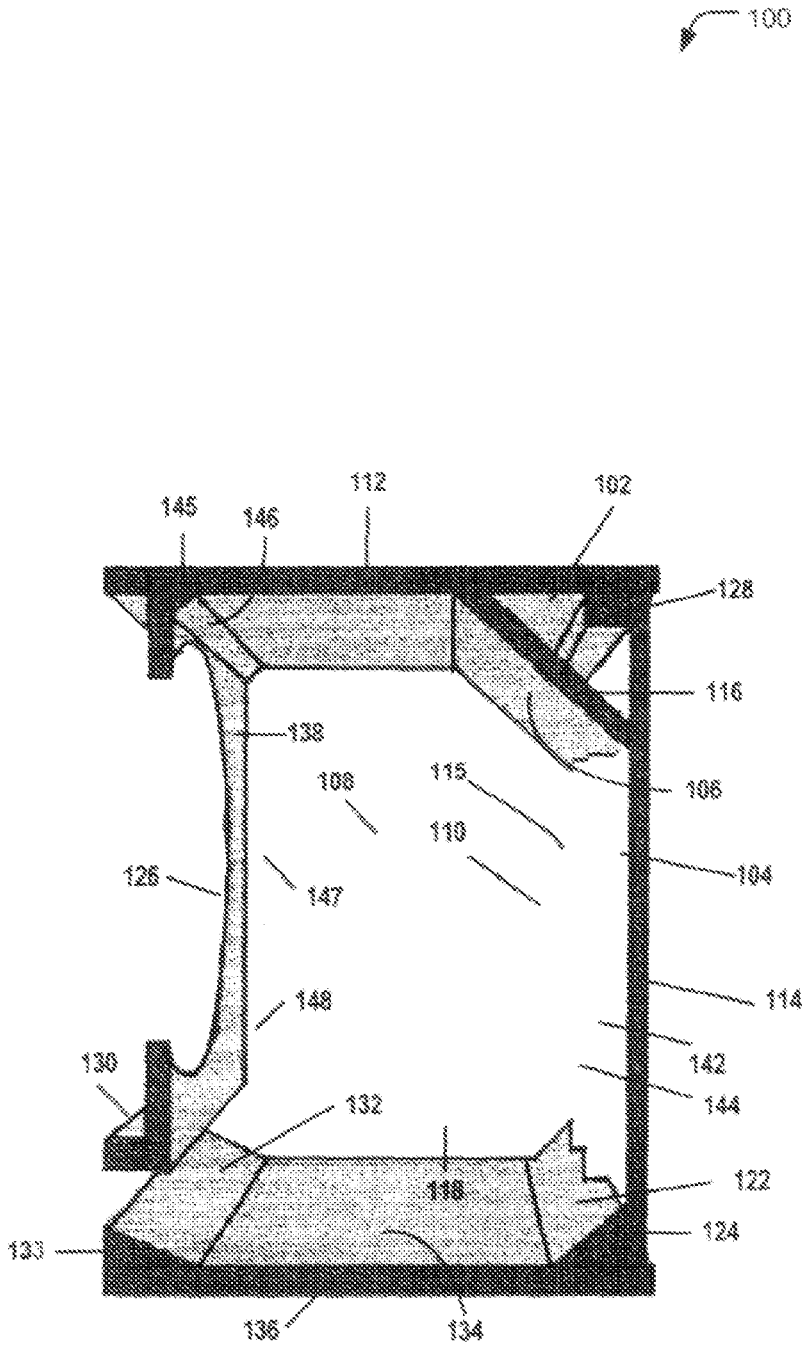

FIG. 1 is a cross-sectional, perspective view of a first embodiment of a speaker cabinet system 100 configured to harness and focus sound waves in a manner that optimizes sound quality. The speaker cabinet system 100, or apparatus, may include a first surface 102 of an exterior to panel 112 that is oriented generally along a first plane. A second surface 104 of an exterior back panel 114 may be oriented generally along a second plane. The second plane may be generally orthogonal to the first plane. A third surface 106 of a sound deflecting panel 116 may be positioned between the first and second surfaces. The third surface 106 may be oriented generally along a third plane that intersects the first plane and the second plane. The third surface 106, as with the first and second surfaces 102, 104, may be configured to redirect an audio signal. The audio signal may be generated by one or more speakers or amplifiers (not shown) positioned within the speaker cabinet system 100.

An exterior side panel 118 may comprise a fourth surface 108 that is generally orthogonal to the respective planes of the first surface 102 and the second surface 104. A fifth surface 110 of a sound deflecting panel 120 may include a plane that intersects the plane of the second surface 104 and the plane of the fourth surface 108. The sound deflection panel 120 may be positioned proximate the exterior back panel 114, a spacer panel 115, and the exterior side panel 118.

A sixth surface 134 of an exterior bottom panel 136 may be parallel to the first surface 102 and the exterior top panel 112. A seventh surface 138 of a baffle board 126 may be parallel to the second surface 104 of the exterior back panel 114. The baffle board 126 may include a cutout or other aperture to accommodate electronic equipment, such as a speaker.

An eighth surface 122 may comprise part of a sound deflecting panel 124 that is positioned proximate the exterior back panel 114 and the exterior bottom panel 136. A ramped cleat 133 may include a ninth surface 132 configured to direct sound waves through an aperture bounded on one side by the baffle board 126. The ramped cleat 133 may be positioned on the exterior bottom panel 136.

A sound deflecting panel 145 may include a tenth surface 146 having a plane that intersects the planes of the first surface 102 and the seventh surface 138. The sound deflecting panel 145 may be positioned proximate exterior top panel 112 and the baffle board 126. A sound deflecting panel 147 may include an eleventh surface 148 having a plane that intersects the planes of the fourth surface 108 and the seventh surface 138. The sound deflecting panel 147 may be positioned proximate exterior side panel 118 and the baffle board 126.

Sound dispersing cleats 142, 144 may be positioned along the second surface 104. The sound dispersing cleats 142, 144 may be configured to disperse sound waves and to otherwise direct sound waves from becoming trapped behind the speaker(s) or amplifier(s). The speaker cabinet system 100 may further include an upper back panel support 128 and a front baffle support 130.

The sound deflecting panels 115, 116, 124, 133, 146, 148 and the sound dispersing cleats 142, 144 may work in combination to minimize occurrences of trapped and absorbed audio signals. The sound deflecting panels 115, 116, 124, 133, 146, 148 and the sound dispersing cleats 142, 144 may reduce pressure in the speaker cabinet 100 and may redirect audio waves to realize increased audio potential. By focusing and harnessing the sound waves, synchronization, tone and overall sound quality may be improved.

Figure 2:
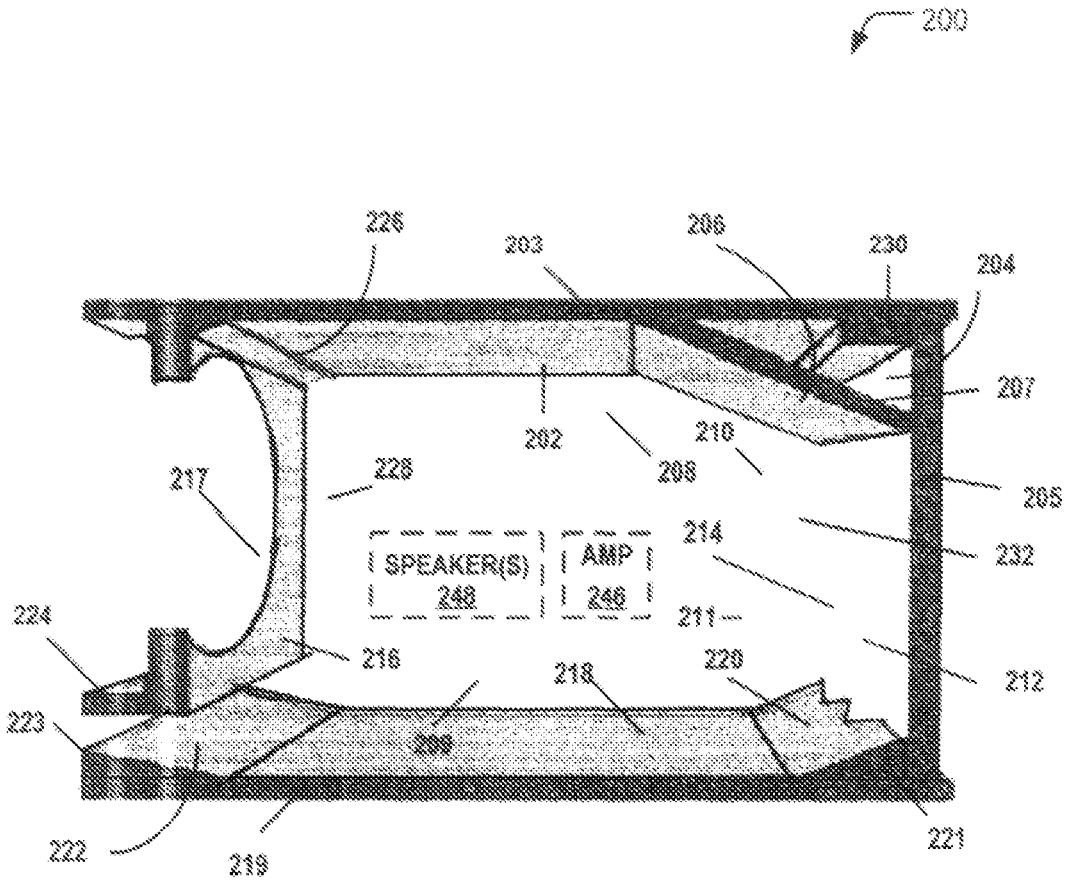
FIG. 2 is a cross-sectional side view of a second embodiment of a speaker cabinet system that includes sound deflecting panels and sound dispersing cleats.

FIG. 2 is a cross-sectional side view of a second embodiment of a cabinet speaker system 200 that includes sound deflecting panels and sound dispersing cleats. The speaker cabinet system 200 may be similar to or the same as the speaker cabinet system 100 of FIG. 1. The speaker cabinet system 200 may include a first surface 202 of an exterior top panel 203 that is oriented generally along a first plane. A second surface 204 of an exterior back panel 205 may be oriented generally along a second plane. The second plane may be generally orthogonal to the first plane. A third surface 206 of a sound deflecting panel 207 may be positioned between the first and second surfaces. The third surface 206 may be oriented generally along a third plane that intersects the first plane and the second plane. The third surface 206, as with the first and second surfaces 202, 204, may be configured to redirect an audio signal.

The audio signal may be generated by one or more speakers 248 and/or an amplifier 246 (shown in block outline form). The amplifier 246 and/or speakers 248 may be positioned within the speaker cabinet system 200.

An exterior side panel 209 may comprise a fourth surface 208 that is generally orthogonal to the respective planes of the first surface 202 and the second surface 204. A fifth surface 210 of a sound deflecting panel 211 may include a plane that intersects the plane of the second surface 204 and the plane of the fourth surface 208. The sound deflection panel 211 may be positioned proximate the exterior back panel 205, the exterior side panel 207, and a spacer panel 232.

A sixth surface 218 of an exterior bottom panel 219 may be parallel to the first surface 202 and the exterior top panel 203. A seventh surface 216 of a baffle board 217 may be parallel to the second surface 204 of the exterior back panel 205. An eighth surface 220 may comprise part of a sound deflecting panel 221 that is positioned proximate the exterior back panel 205 and the exterior bottom panel 219.

A ramped cleat 223 may include a ninth surface 222 configured to direct sound waves through an aperture bounded on one side by the baffle board 217. The ramped cleat 223 may be positioned on the exterior bottom panel 219.

Sound dispersing cleats 212, 214 may be positioned along the second surface 204. The sound dispersing cleats 212, 214 may be configured to disperse sound waves and to otherwise direct sound waves from becoming trapped behind the amplifier 246 or speaker(s) 248. The speaker cabinet system 200 may further include an upper back panel support 230 and a front baffle support 224.

Figure 3:
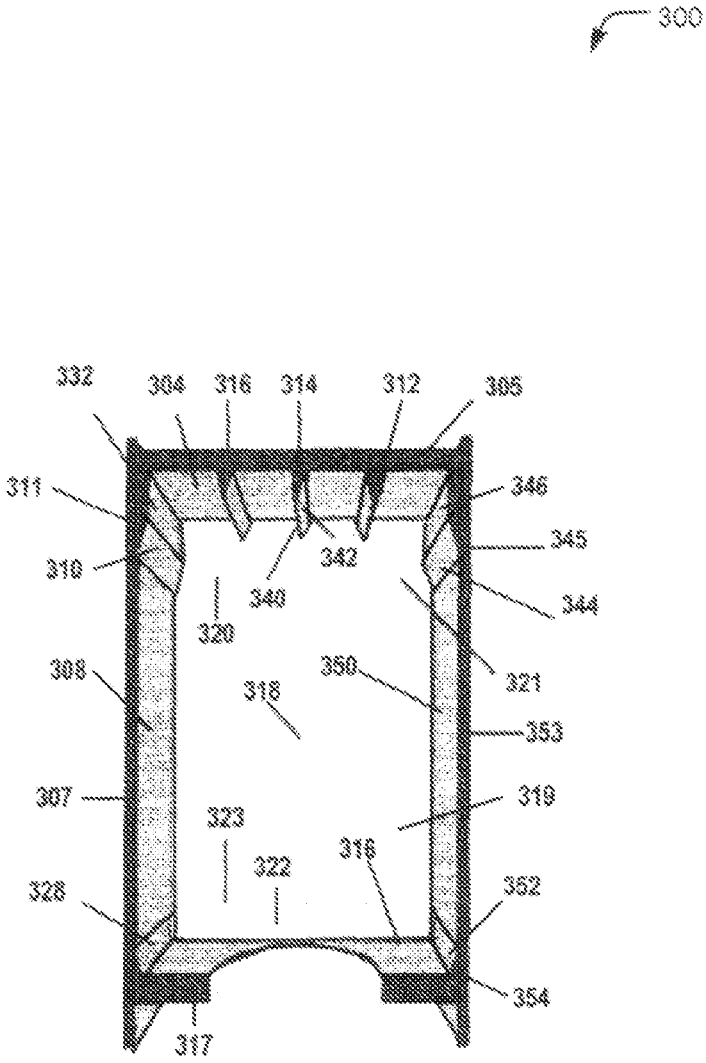
FIG. 3 is a cross-sectional top view of a third embodiment of a speaker cabinet system configured to focus audio waves.

FIG. 3 is a cross-sectional top view of a third embodiment of a speaker cabinet system 300 that includes sound deflecting panels and sound dispersing cleats. The speaker cabinet system 300 may be similar to or the same as the speaker cabinet systems 100, 200 of FIGS. 2 and 3. The speaker cabinet system 300 may include a first surface 318 of an exterior bottom panel 319 that is oriented generally along a first plane. A second surface 304 of an exterior back panel 305 may be oriented generally along a second plane. The second plane may be generally orthogonal to the first plane. A third surface 320 of a sound deflecting panel 321 may be positioned between the first and second surfaces. The third surface 320 may be oriented generally along a third plane that intersects the first plane and the second plane. The third surface 320, as with the first and second surfaces 318, 304, may be configured to redirect an audio signal. The audio signal may be generated by an amplifier and one or more speakers (not shown) positioned within the amplifier cabinet system 300.

An exterior side panel 307 may comprise a fourth surface 308 that is generally orthogonal to the respective planes of the first surface 318 and the second surface 304. A fifth surface 310 of a sound deflecting panel 311 may include a plane that intersects the plane of the second surface 304 and the plane of the fourth surface 308. The sound deflection panel 311 may be positioned proximate the exterior back panel 305, the exterior side panel 307, and a spacer panel 332.

A sixth surface 316 of a baffle board 317 may be parallel to the second surface 304 of the exterior back panel 305. A seventh surface 344 may comprise part of a sound deflecting panel 345 that is positioned proximate an exterior side panel 353, the exterior bottom panel 319, and a spacer panel 346. An eighth surface 352 may comprise part of a sound deflecting panel 354 that is positioned proximate the exterior side panel 353, the baffle board 317, and the exterior bottom panel 319.

A ramped cleat 323 may include a ninth surface 322 configured to direct sound waves through an aperture bounded on one side by the baffle board 317. The ramped cleat 323 may be positioned on the exterior bottom panel 319.

Sound dispersing cleats 312, 314, and 316 may be positioned along the second surface 304. The sound dispersing cleats 312, 314, and 316 may be configured to disperse sound waves and to otherwise direct sound waves from becoming trapped behind the amplifier and/or the speakers). As shown in FIG. 3, the illustrative sound dispersing cleat 314 may be elongated and include multiple sound reflecting surfaces 340, 342.

Figure 4:
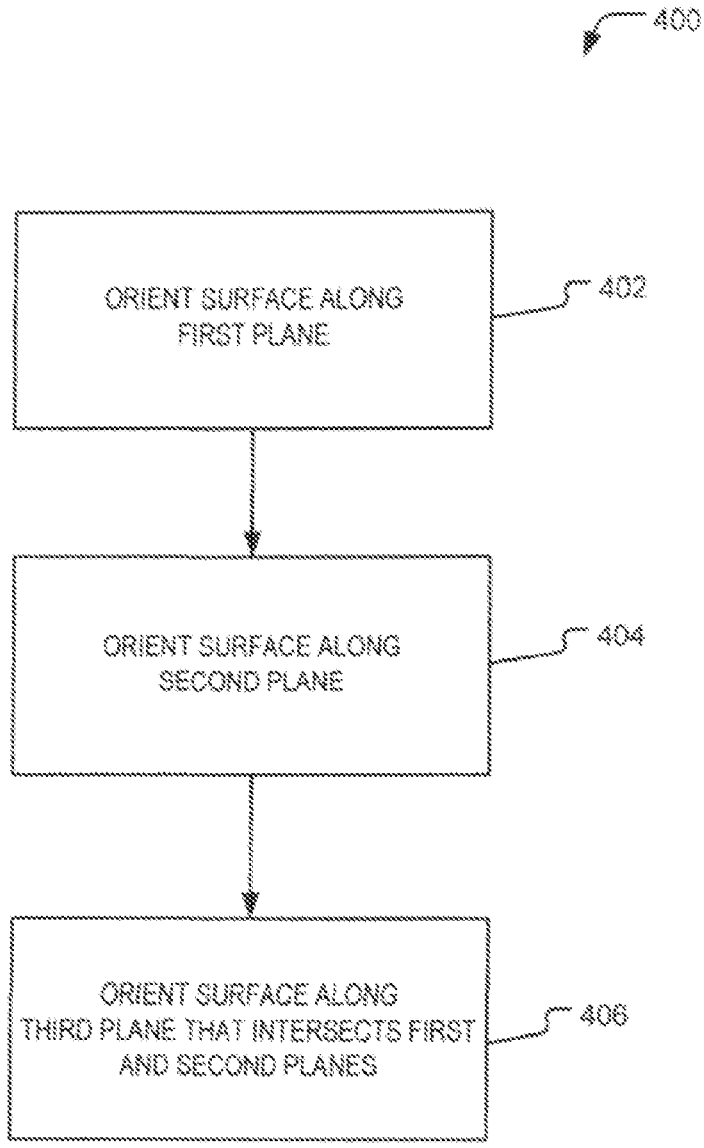
FIG. 4 is a flowchart of an embodiment of a method of constructing a speaker cabinet.

FIG. 4 is a flowchart 400 of an embodiment of a method of constructing a speaker cabinet, such as the speaker cabinet system 100 of FIG. 1. At 402, a first surface may be oriented generally along a first plane. For example, the first surface 102 of the exterior top panel 112 of FIG. 1 may be oriented along the first plane.

A second surface may be oriented generally along a second plane, at 404. The second plane may be generally orthogonal to the first plane. For instance, the second surface 104 of the exterior back panel 114 may be oriented orthogonally with respect to the exterior top panel 112 of FIG. 1. At 406, a third surface may be positioned between the first and second surfaces. The third surface may oriented generally along a third plane that intersects the first plane and the second plane and is configured to redirect an audio signal. For example, the third surface 106 of FIG. 1 may be oriented along a plane that intersects the first and second plane. The third surface 106 may comprise part, of the sound deflecting panel configured to redirect sound waves.

While the present invention has been illustrated by a description of various embodiments and while these embodiments have been described in considerable detail, it is not the intention of the Applicant to restrict, or any way limit the scope of the appended claims to such detail. For example, embodiments may include both combination and stand alone arrangements. The speaker system may include wood, plastic, metal or any suitable construction material. Sound deflecting panels and sound dispersing cleats may include contoured surfaces, where advantageous. The invention in its broader aspects is therefore not limited to the specific details, representative apparatus, method, and illustrative examples shown and described. Accordingly, departures may be made from such details without departing from the spirit or scope of Applicant's general inventive concept.

The invention claimed is:

1. A speaker cabinet, comprising: a first surface oriented generally along a first plane; a second surface oriented generally along a second plane, wherein the second plane is generally orthogonal to the first plane; a third surface positioned between the first and second surfaces and oriented generally along a third plane that intersects the first plane and the second plane, wherein the third surface is configured to redirect an audio signal, wherein the third surface comprises a first side of an audio reflective panel having a second side proximate the first surface and a third side proximate the second surface and wherein both the third surface and the second surface are generally planar; a fourth surface that is oriented generally along a fourth plane that is orthogonal to the first plane and the second plane; and a fifth surface positioned between the second and fourth surfaces and oriented generally along a fifth plane that intersects the second plane and the fourth plane, wherein the fifth surface is configured to redirect the audio signal, wherein at least one of the third surface and the second surface is generally planar; and an elongated sound dispersing cleat positioned on at least one of the first and second surfaces to disperse sound waves, wherein the sound dispersing cleat includes an edge and is constructed from substantially solid wood or plastic material.

2. The speaker cabinet of claim 1, further comprising a speaker configured to generate the audio signal.

3. The speaker cabinet of claim 1, wherein the third surface includes at least one of wood and plastic.

4. The speaker cabinet of claim 1, further comprising an aperture formed between a baffle board and an exterior panel.

5. A method of constructing a speaker cabinet, the method comprising: orienting a first surface generally along a first plane; orienting a second surface generally along a second plane, wherein the second plane is generally orthogonal to the first plane; positioning a third surface between the first and second surfaces, wherein the third surface is oriented generally along a third plane that intersects the first plane and the second plane mad is configured to redirect an audio signal, wherein the third surface comprises a first side of an audio reflective panel having a second side proximate the first surface and a third side proximate the second surface and wherein both the third surface and the second surface are generally planar; orienting a fourth surface generally along a fourth plane that is orthogonal to the first plane and the second plane; orienting a fifth surface generally along a fifth plane that intersects the second plane and the fourth plane, wherein the fifth surface is positioned between the second and fourth surfaces, wherein at least one of the third surface and the second surface is generally planar; and positioning an elongated sound dispersing cleat on at least one of the first and second surfaces to disperse sound waves, wherein the sound dispersing cleat includes an edge and is constructed from substantially solid wood or plastic material.

6. The method of claim 5, further comprising using a speaker to generate the audio signal.

7. The method of claim 5, further comprising positioning a speaker within the speaker cabinet.

8. The method of claim 5, further including first and second apertures proximate the first surface, wherein the first aperture is proximate a speaker, and the second aperture is present along a length of the first surface.

* * * * *